United States Patent [19]

Sando et al.

[11] 4,182,142

[45] Jan. 8, 1980

[54] CONTINUOUS CLOTH DYEING-AND-WASHING APPARATUS

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 920,647

[22] Filed: Jun. 30, 1978

[30] Foreign Application Priority Data

Jul. 7, 1977 [JP] Japan ..... 52/81281

[51] Int. Cl.[2] ..... D06B 3/12; D06B 21/02; D06B 23/18

[52] U.S. Cl. ..... 68/5 E; 68/9; 68/183

[58] Field of Search ..... 8/149.1; 68/5 E, 9, 68/62, 175, 183

[56] References Cited

U.S. PATENT DOCUMENTS 3,954,404 5/1976 Childers et al. ..... 8/149.1 X
4,004,879 1/1977 Meier-Windhorst et al. ..... 68/62 X

FOREIGN PATENT DOCUMENTS 51-18548 6/1976 Japan ..... 68/183
340458 8/1972 U.S.S.R. ..... 68/5 E

*Primary Examiner*—Philip R. Coe
*Attorney, Agent, or Firm*—Toren, McGeady and Stanger

[57] ABSTRACT

A continuous cloth dyeing-and-washing apparatus of simplified construction comprising a liquid reservoir divided into a dye solution liquid reservoir and a washing liquid reservoir; a vertical cover which has its lower side open with the edge portion of the open lower side immersed in the liquids contained in the dye solution reservoir and the washing liquid reservoir to keep the inside of the cover air-tight; spaces formed between outer wall faces of the open lower side of the vertical cover and the inner wall faces of the dye solution reservoir and the washing liquid reservoir to allow a cloth material to pass therethrough respectively; guide rolls vertically arranged inside the vertical cover in two columns and in many steps to allow the cloth material to ascend zigzag for a hygro-thermic treatment with steam jet pipes arranged within the vertical cover; and a group of guide rolls arranged within the washing liquid reservoir to allow the cloth material to travel zigzag for washing therein with air jet pipes arranged to ensure thorough washing.

1 Claim, 1 Drawing Figure

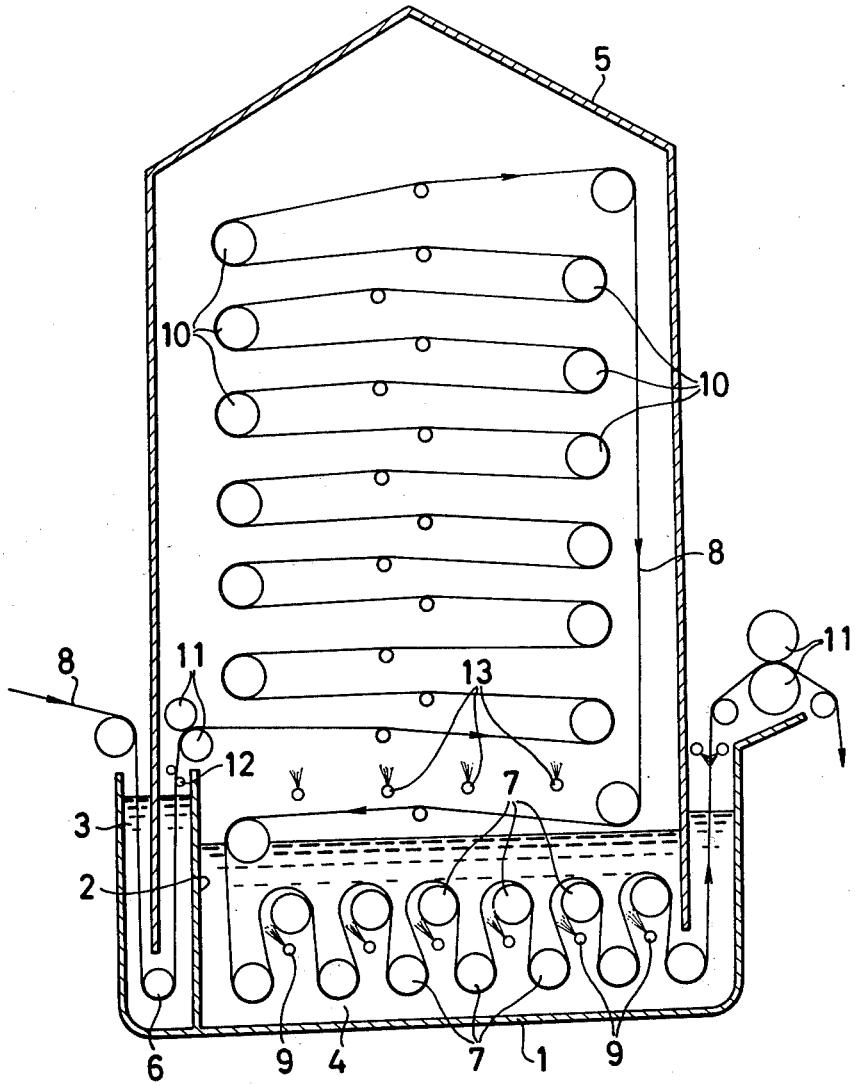
5
10
10
8
11
11
8
13
12
7
3
2
6
9
4
7
1
9

CONTINUOUS CLOTH DYEING-AND-WASHING APPARATUS

BACKGROUND OF THE INVENTION

1. Field of the Invention

This invention relates to a continuous dyeing-and-washing apparatus of simple construction capable of continuously and effectively carrying out a cloth material dyeing process.

2. Description of the Prior Art

A dye fixing process is generally carried out either by immersing a cloth material to which a dye has been applied in hot water or by subjecting it to a hygro-thermic treatment under humid heat. Heretofore, a cloth material to be dyed, for example, has been allowed to pass through the inside of a dye solution reservoir to apply a dye thereto and then subjected to a hygro-thermic treatment carried out within a steamer at a temperature of 100° C. or below for color development. The conventional dyeing method thus has necessitated the use of a dye solution applying reservoir, a vat steamer and a washing tank. Such facilities are extensive and require a large space. Besides, in the case of a dyeing process by humid heat of temperature less than 100° C., a long period of time is necessary before the dye is fixed to the cloth material. This has presented an economical problem.

The inventors of the present invention, therefore, conducted studies over a long period in the past for shortening the fixing time by a high speed dye fixing process. As a result of these studies, they have developed a high pressure steamer which is capable of dyeing a cloth material in a matter of seconds and is now in use. According to the method for dyeing with the high pressure steamer, the humid heat inside the steamer can be raised up to about 170° C., which permits dyeing cloth materials at a high speed in a matter of seconds. On the other hand, however, the high pressure steamer is large in size and requires a high cost. Besides, the installation cost of it is very high and it also requires a large space for installation. Further, before the start of an operation of the high pressure steamer, temperature and pressure inside the steamer must be raised up to a preset levels respectively. This requires a long period of time for preparation before start-up and thus the high pressure steamer has presented another problem.

The present invention is directed to the eliminate on of the shortcomings of the conventional method and the prior art.

SUMMARY OF THE INVENTION

It is, therefore, an object of this invention to provide a simple continuous dyeing apparatus which is capable of giving humid heat of 105° to 110° C., though it is impossible to obtain the same high temperature and high pressure as the high pressure steamer of the above stated prior art, and is of simplified construction requiring almost no preparation time before starting its operation.

The above and other objects and advantages of the invention will be apparent from the following detailed description of a preferred embodiment thereof when read in connection with the accompanying drawing.

BRIEF DESCRIPTION OF THE DRAWING

The accompanying drawing is a sectional view showing a continuous dyeing-and-washing apparatus as preferred embodiment of the invention.

DETAILED DESCRIPTION OF PREFERRED EMBODIMENT

Referring to the accompanying drawing, a liquid reservoir 1 which is square in its plan and has an open top is divided by a partition wall 2 into a dye solution reservoir 3 and a washing liquid reservoir 4. A vertical cover 5 which is also square in its plan and has a closed upper side and an open lower side is formed to have its open lower side smaller than the open top of the liquid reservoir 1. The edge portions of the open lower side of the vertical cover is immersed in liquids contained in the dye solution reservoir 3 and the washing liquid reservoir 4 while the inside of the vertical cover 5 is kept air-tight. A cloth material guide roll 6 is disposed inside the dye solution reservoir 3 above the bottom thereof. In the bottom area inside the washing liquid reservoir 4, there are many guide rolls 7, which are arranged in upper and lower rows to guide a cloth material 8 up and down in a zigzag manner. There are arranged air jet pipes 9 inside the washing liquid reservoir to apply air to areas between the guide rolls of the upper row and the cloth material 8. Inside the vertical cover 5, there are many guide rolls 10 which are arranged in left and right columns and in many steps to guide the cloth material 8 left and right in a zigzag fashion. A pair of wringer rolls 11 are arranged in pressed contact with each other above the dye solution reservoir 3. Closer to the dye solution reservoir 3 than the wringer rolls 11 are arranged scraper rods 12 to scrape off a part of the dye solution with which the cloth material guided out of the reservoir 3 has been impregnated. Steam jet pipes 13 are arranged to blow steam into the vertical cover 5. The inside of the vertical cover 5 can be kept at humid heat of about 105° to 110° C. by the steam from the steam jet pipes 13 in conjunction with a liquid seal action by the liquid contained in the dye solution reservoir 3 and the washing liquid reservoir 4.

The apparatus described above operates as follows: The cloth material 8 comes into the dye solution reservoir 3 through a space provided between the dye solution reservoir 3 and the edge portion of the open lower side of the vertical cover 5 and is transferred to the inside of the vertical cover 5 through the guide roll 6 after having been impregnated with a dye solution contained in the reservoir 3. The quantity of the dye solution with which the cloth material has been impregnated is adjusted to a desired quantity through the scraper rods 12 and the wringer rolls 11. Then, the guide rolls 10 arranged within the vertical cover causes the cloth material to ascend zigzag inside of the cover 5 in a creeping manner. While travelling in this manner, the cloth material receives a humid heat of 105° to 110° C. at which the inside of the vertical cover 5 is maintained. Then, color development and dye fixation take place on the cloth material as it moves within the vertical cover 5. With the dye thus having been fixed thereto, the cloth material 8 is forwarded into the washing liquid reservoir 4 of the liquid reservoir 1 and is caused by guide rolls 7 to travel along a zigzag path. During the zigzag travel, the air which is spurted from the air jet pipes 9 is forced into spaces between the cloth material 8 and the guide rolls 7. Further, the air and the washing liquid are caused by the force of pressed contact between the cloth material and the guide rolls to penetrate the cloth material between its fibers to ensure effective washing. The cloth material which has been thoroughly washed in this manner comes to the outside through a space arranged between the edge portion of the open lower side of the vertical cover 5 and the washing liquid reservoir 4.

In accordance with this invention, the open lower side of the vertical cover 5 is immersed in the liquids contained in the liquid reservoir 1. By this, the inside of the vertical cover 5 is kept air-tight while hygro-thermic pressure within the vertical cover 5 can be made higher than normal pressure owing to liquid pressure within the liquid reservoir 1 and the temperature thereof can be kept, for example, between 105° and 110° C. Thus, in accordance with this invention, the cloth material impregnated with a dye solution is subjected to a hygro-thermic reatment under a humid heat of 105° to 110° C. Compared with the conventional method wherein a hygro-thermic treatment is carried out at a temperature below 100° C. (actually 95° C.), the invented apparatus is capable of completing fixation of dyes in less than one half the time required by the conventional method. Further, in the washing process, the cloth material which has swelled up by the humid heat is immediately immersed in hot water. Therefore, washing can be very effectively carried out in a short period of time with a small quantity of hot water or the like. This feature contributes to economization in water resources and heat energy.

The impregnation of a cloth material with a dye solution, the hygro-thermic treatment and the washing process can be continuously carried out with a very simple structural arrangement. Therefore, a low cost continuous dyeing-and-washing apparatus can be obtained in accordance with the present invention.

What is claimed is:

1. A continuous cloth dyeing-and-washing apparatus comprising first walls forming a liquid reservoir closed at its sides and bottom and open at its top, an upwardly extending partition wall located within said reservoir dividing it into a dyeing solution reservoir and a washing liquid reservoir disposed in side-by-side relation, said dye solution reservoir and washing liquid reservoir each having a liquid level therein, second walls forming a vertically extending cover tank closed at its upper end and sides and open at its bottom, the bottom of said cover tank having a horizontal cross sectional area and shape such that it fits downwardly into said liquid reservoir with the sides of said cover tank spaced inwardly from the sides of said liquid resrvoir so that the bottom ends of the sides of said cover tank extend downwardly into said dye solution reservoir and said washing liquid reservoir below the liquid levels therein so that the liquid therein forms a seal for the bottom end of said cover tank, a cloth material inlet into said dye solution reservoir and a cloth material outlet out of said washing liquid reservoir being formed by the sides of said cover tank and the adjacent outwardly spaced sides of said liquid reservoir, a plurality of vertically spaced horizontally arranged first guide rolls located in said cover tank above the liquid level in said washing liquid reservoir, said first guide rolls disposed in two vertically extending rows spaced horizontally apart so that the cloth material travelling back and forth over said first guide rolls from one vertical row to the other moves along a zigzag path, a plurality of horizontally arranged second guide rolls located in said washing liquid reservoir below the liquid level therein and arranged in two horizontal rows comprising an upper row and a lower row so that the cloth material in said washing liquid reservoir can pass over said second guide rolls moving back and forth from the upper horizontal row to the lower horizontal row so that the cloth material moves in a generally vertically arranged zigzag path through said washing liquid reservoir, means located in said cover tank for supplying steam thereto for maintaining the interior of said cover tank under humid heat conditions, and air jet pipes located within said washing liquid reservoir between said upper horizontal row and lower horizontal row with said jet pipes arranged to direct air toward the cloth material as it moves upwardly around said second guide rolls in said upper horizontal row so that air and washing liquid penetrate between the fibers of the cloth material due to the pressed contact of the cloth material against said second guide rolls.

* * * * *